US008621667B2

(12) United States Patent
Kordon

(10) Patent No.: US 8,621,667 B2
(45) Date of Patent: Jan. 7, 2014

(54) VISORED CLOTH HEADGEAR

(76) Inventor: Timothy Kordon, Purcelville, VA (US)

( * ) Notice: Subject to any disclaimer, the term of this patent is extended or adjusted under 35 U.S.C. 154(b) by 138 days.

(21) Appl. No.: 13/101,555

(22) Filed: May 5, 2011

(65) Prior Publication Data

US 2012/0278971 A1 Nov. 8, 2012

(51) Int. Cl.
*A42B 1/06* (2006.01)

(52) U.S. Cl.
USPC ..... 2/195.1; 2/209.12

(58) Field of Classification Search
USPC ..... 2/207, 202, 203, 204, 209.12, 195.1, 2/171.6, 174, 171, 209.3, 209.4, 195.2, 2/195.6, DIG. 11
See application file for complete search history.

(56) References Cited

U.S. PATENT DOCUMENTS

| | | | | | |
|---|---|---|---|---|---|
| 2,005,361 | A | * | 6/1935 | Rollins et al. | 2/195.1 |
| 2,089,995 | A | * | 8/1937 | Dobbs | 2/207 |
| D135,321 | S | * | 3/1943 | Harpignies | D2/879 |
| 2,574,208 | A | * | 11/1951 | Crowthers | 2/207 |
| 2,859,448 | A | | 4/1956 | Gaichel | |
| 2,988,748 | A | * | 6/1961 | Rollins-Dudley | 2/202 |
| 3,480,970 | A | * | 12/1969 | Gettinger | 2/207 |
| 5,048,128 | A | * | 9/1991 | Watson, Jr. | 2/204 |
| 5,253,369 | A | * | 10/1993 | Patterson, Jr. | 2/207 |
| 5,381,559 | A | * | 1/1995 | Wakefield, III | 2/267 |
| 5,493,732 | A | * | 2/1996 | Fawkes | 2/195.1 |
| 5,542,127 | A | | 8/1996 | Bezanis | |
| D419,750 | S | | 2/2000 | Bazin | |
| D474,578 | S | * | 5/2003 | Johnson | D2/879 |
| 7,836,522 | B2 | | 11/2010 | Blecha | |
| 2006/0005297 | A1 | * | 1/2006 | Blecha | 2/207 |

* cited by examiner

*Primary Examiner* — Amy Vanatta
(74) *Attorney, Agent, or Firm* — Michael L. Greenberg, Esq.; Greenberg & Lieberman, LLC

(57) ABSTRACT

An item of headgear comprised of a visor bill attached to a square piece of cloth along the diagonal of the cloth and slightly below the center of the cloth. The visor bill is encased in a pocket-shaped visor bill cover before it is stitched to the square piece of cloth. The present invention can be worn as a visor, or it can be opened up and wrapped over the top of the head to form the shape of a more traditional hat.

9 Claims, 8 Drawing Sheets

VISORED CLOTH HEADGEAR

The present invention is an item of headgear comprised of a visor bill attached to a square piece of cloth along the diagonal of the cloth and slightly below the center of the cloth. The visor bill is encased in a pocket-shaped visor bill cover before it is stitched to the square piece of cloth. The present invention can be worn as a visor, or it can be opened up and wrapped over the top of the head to form the shape of a more traditional hat.

BACKGROUND OF THE PRESENT INVENTION

Headgear such as hats, caps and bandanas are necessary in sunny weather to protect a user from the deleterious effects of excessive sunlight. The number of types and styles of headgear available is nearly unlimited, yet there is always room for a new style of headgear that embodies the user's style preferences while offering protection from the sun.

The present invention joins together a conventional visor bill and a conventional piece of cloth in an unconventional manner to create an unconventional type of headgear. The present invention is comprised of a visor bill attached to a square piece of cloth along the cloth's diagonal and slightly below the cloth's center. The present invention can be worn like a visor, or can be opened up and wrapped over the top of the head to look like a more traditional hat.

U.S. Pat. No. 2,859,448 is for "Article of Headwear" issued to Gaichel on Apr. 30, 1956. Gaichel employs a visor in combination with a scarf in order to "provide a head covering for holding the hair in place and also a sun shield for protecting the face and eyes of the wearer." Unlike the present invention, Gaichel employs a visor that clips to a scarf by means of gripping members so that a user may alternate what scarves are used in conjunction with the visor, whereas the present invention envisions a section of cloth that is stitched or otherwise permanently attached to the visor.

U.S. Pat. No. 5,542,127 is for "Combined Bandana and Visor Headwear" issued to Bezanis on Aug. 6, 1996. Bezanis has as one of its objectives "to provide an article of headwear which provides the aesthetic appeal of a bandana with the functional advantages of a baseball type cap." Bezanis is described as "a visor brim in the form of a bill, a self-supporting upstanding crown, and a triangular bandana cloth," and as basically comprising "a visor brim, a crown, and a bandana cloth." Bezanis differs from the present invention, in that Bezanis employs a visor, a crown piece, and a bandana attached to the crown piece, whereas the present invention is a visor and cloth, with the cloth stitched to the visor itself.

U.S. Design Pat. No. Des. 419,750 is for a "Combined Sun Visor and Bandana" issued to Bazin on Feb. 1, 2000. Bazin "consists of a sun visor, and more particularly, to the combination of a sun visor and bandana or other style of headband, and an attachment mechanism for releasably securing the bandana to the visor." Unlike the present invention, Bazin's bandana is detachable from the visor, whereas the present invention envisions a piece of cloth that is stitched or otherwise permanently attached to the visor.

U.S. Pat. No. 7,836,522 is for "Bandana Headwear with Flexible Headband, Having Options of Reversibility, Attachable Visor, Attached Cap and 3-Way Visor" issued to Blecha on Nov. 23, 2010. Blecha is a headband and bandana combination with an optional "3-way Visor [that] allows twelve different looks." Unlike the present invention, Blecha emphasizes its variability to match an individual's stylistic preferences, whereas the present invention envisions a piece of cloth that is stitched or otherwise permanently attached to the visor.

SUMMARY OF THE PRESENT INVENTION

The present invention is an item of headgear comprised of a visor bill attached to a square piece of cloth along the diagonal of the cloth and slightly below the center of the cloth. The visor bill itself is covered with cloth material before the visor bill is sewn to the square cloth. The present invention can be worn like a visor, or it can be opened up and wrapped over the top of the head to be worn like a more traditional hat.

FIGURES OF THE PRESENT INVENTION

DETAILED DESCRIPTION OF THE PRESENT INVENTION

Figure 1:
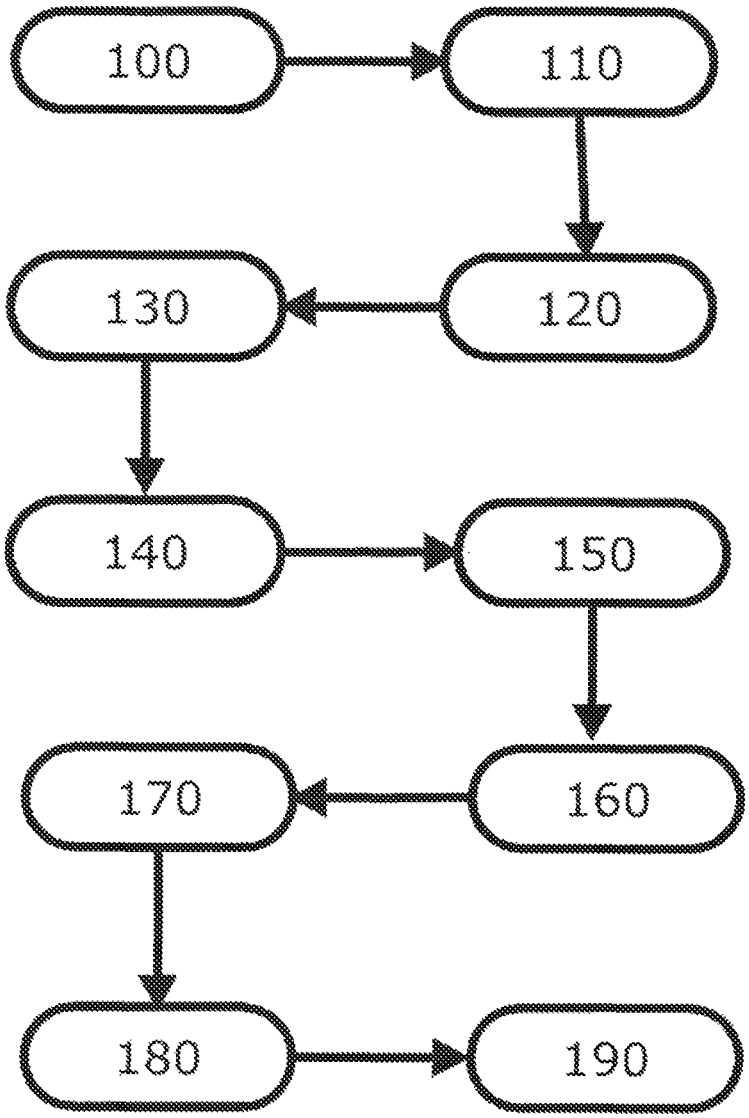
FIG. 1 is a flowchart showing the initial steps of constructing the present invention.

The present invention is a visored cloth headgear. A conventional visor bill (10) is inserted into a pocket-shaped visor bill cover (20) (herein referred to as "visor bill cover") which is then stitched to a main headgear cloth (30) (herein referred to as "cloth") along the diagonal and slightly below the center of the cloth (30). The present invention can be worn like a visor, or it can be opened up and wrapped over the top of the head to look like a more traditional hat.

The materials and components mentioned in the figures below are as follows: a conventional plastic visor bill (10) with an approximate thickness of 5 millimeters; a cloth (30), sized two feet by two feet; a visor bill cover (20) into which the visor bill (10) is inserted and stitched; a top lip (63) and bottom lip (66) of cloth material on the visor bill cover (20); a slit (67) on the cloth (30) that is the point of attachment for the visor bill cover (20); stitching (40) made by conventional thread; a first style (96), a second style (97), and a third style (98) of the present invention; and a tie (85) formed from the cloth (30).

FIG. 1 is a flowchart showing the initial steps of constructing the present invention. A conventional logo or pattern is pre-printed or embroidered on the visor bill cover and cloth of the present invention (100). Stitching is placed along the edges of the visor bill cover and cloth to prevent unraveling (110). The visor bill is trimmed to a curved shape with two arcs (120), and the visor bill cover is shaped leaving an extra inch or so around its edges (130). The shape of the visor bill is then traced onto the visor bill cover in order to make guidelines for stitching (140), and a stitched edge is made to form a front radius (150). Excess material is trimmed off the stitched edge of the visor bill cover (160), which is then turned inside out (170) in order to receive the insertion of the visor bill (180). The open end of the visor bill cover is then stitched so as to enclose the visor bill, with a top lip and a bottom lip of cloth material left remaining at the edge of the visor bill cover (190).

Figure 2:
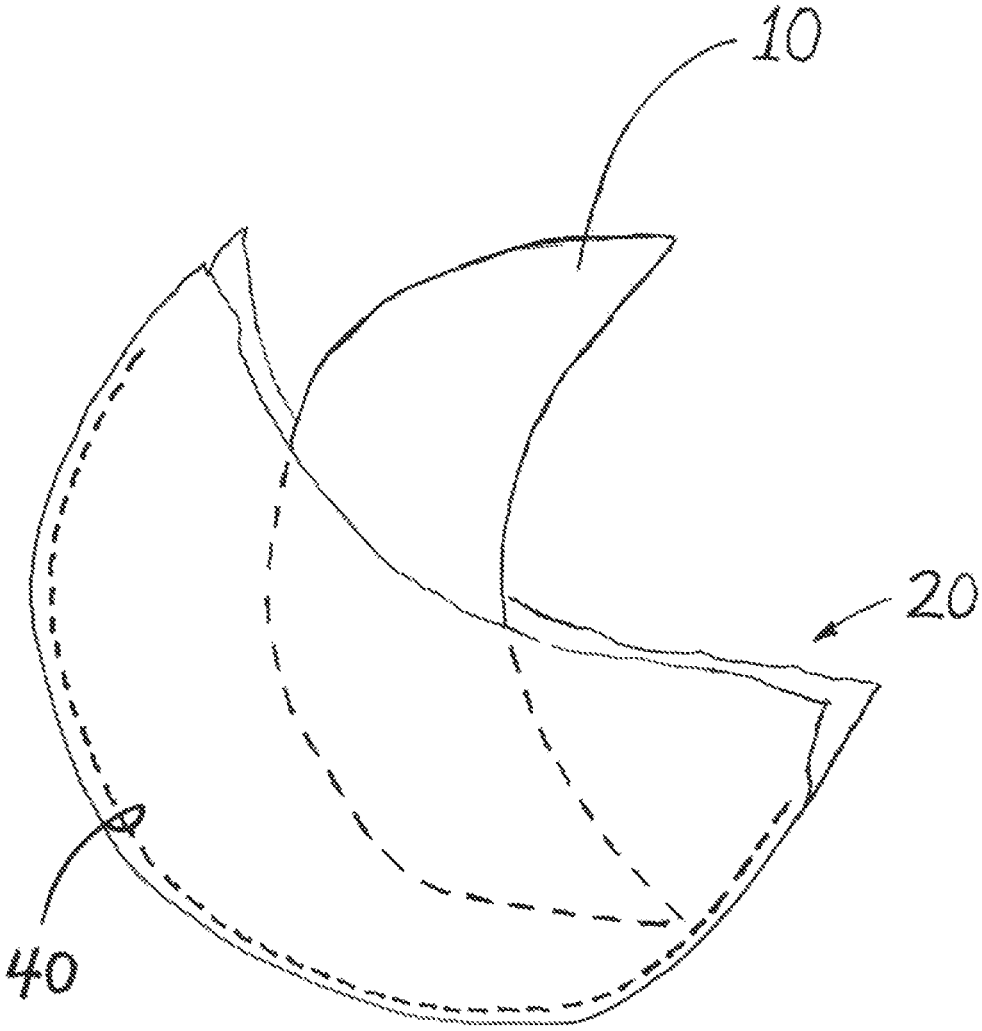
FIG. 2 illustrates step (180) of the flowchart shown in FIG. 1.

FIG. 2 illustrates step (180) of the flowchart shown in FIG. 1. FIG. 2 shows the visor bill (10) being inserted into the visor bill cover (20). The stitching (40) used to sew the visor bill cover (20) is also shown.

Figure 3:
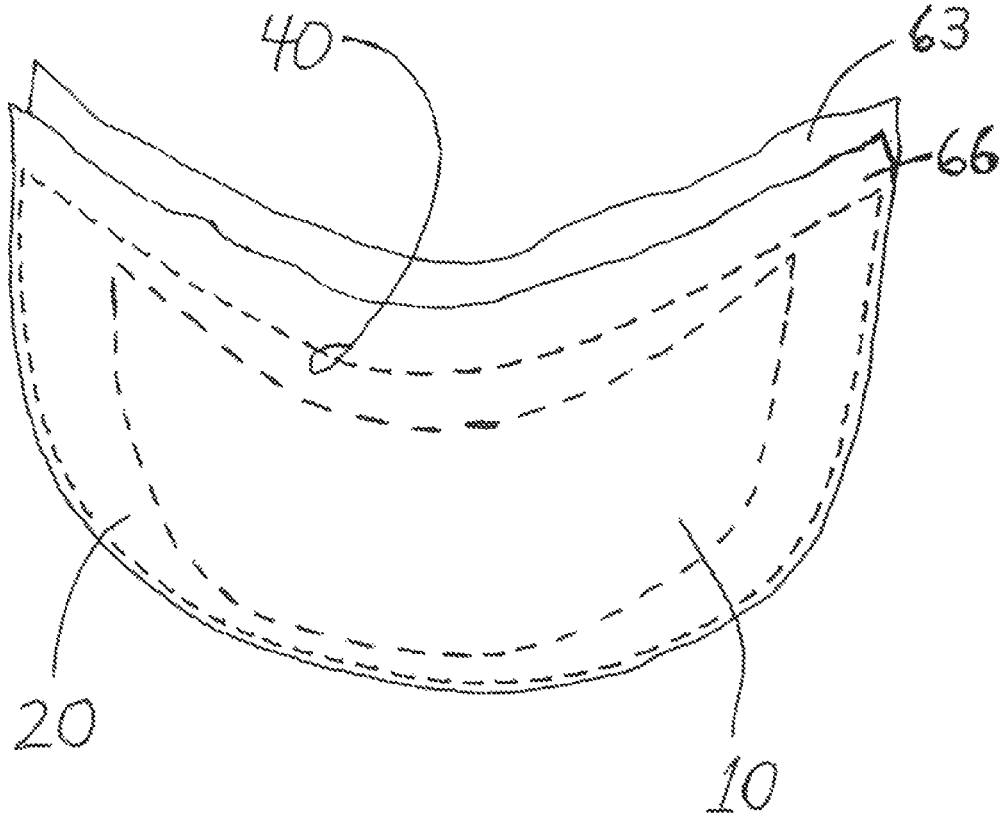
FIG. 3 illustrates step (190) of the flowchart shown in FIG. 1.

FIG. 3 illustrates step (190) of the flowchart shown in FIG. 1. The visor bill cover (20) is stitched to hold the visor bill (10) (shown in silhouette), with a top lip (63) and a bottom lip (66) of cloth material left remaining on the visor bill cover (20). The stitching (40) is visible where the visor bill cover (20) was stitched to enclose the visor bill (10) (shown in silhouette).

Figure 4:
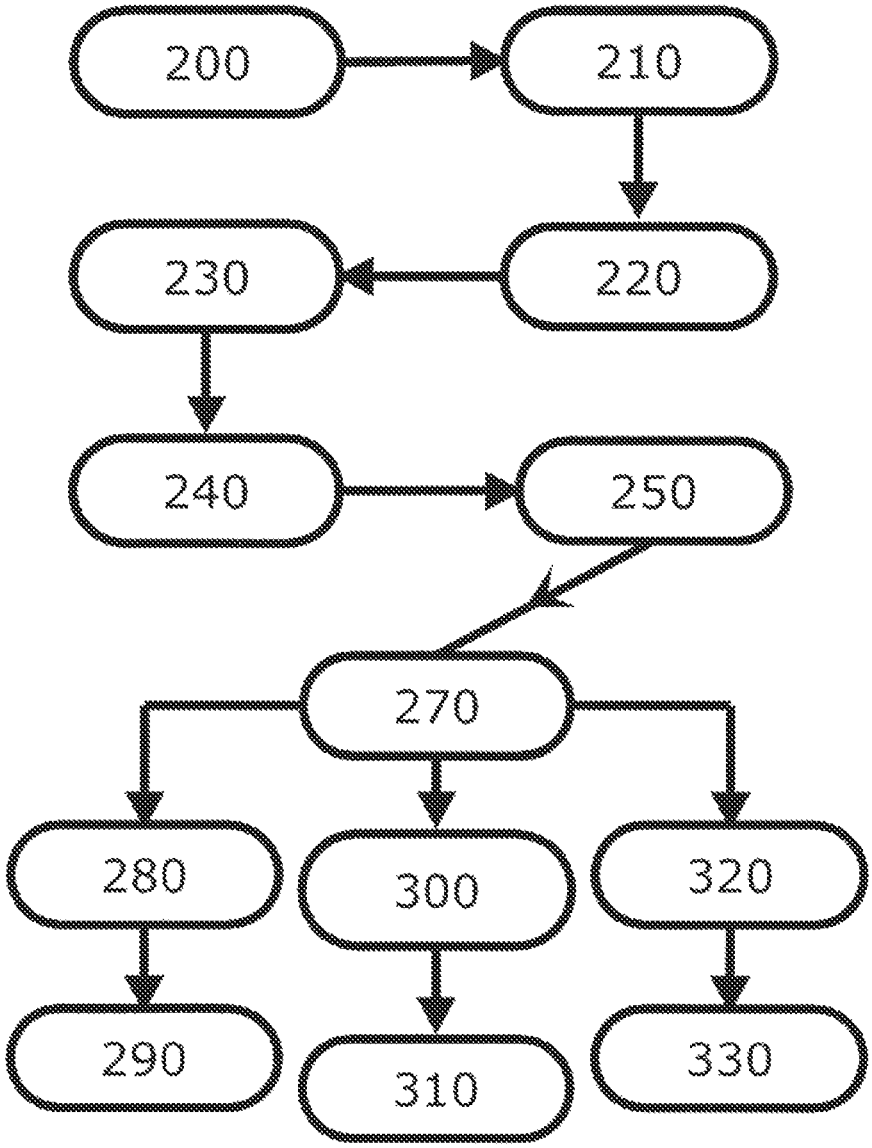
FIG. 4 is a continuation of the flowchart shown in FIG. 1, showing the concluding steps of constructing the present invention.
Figure 6:
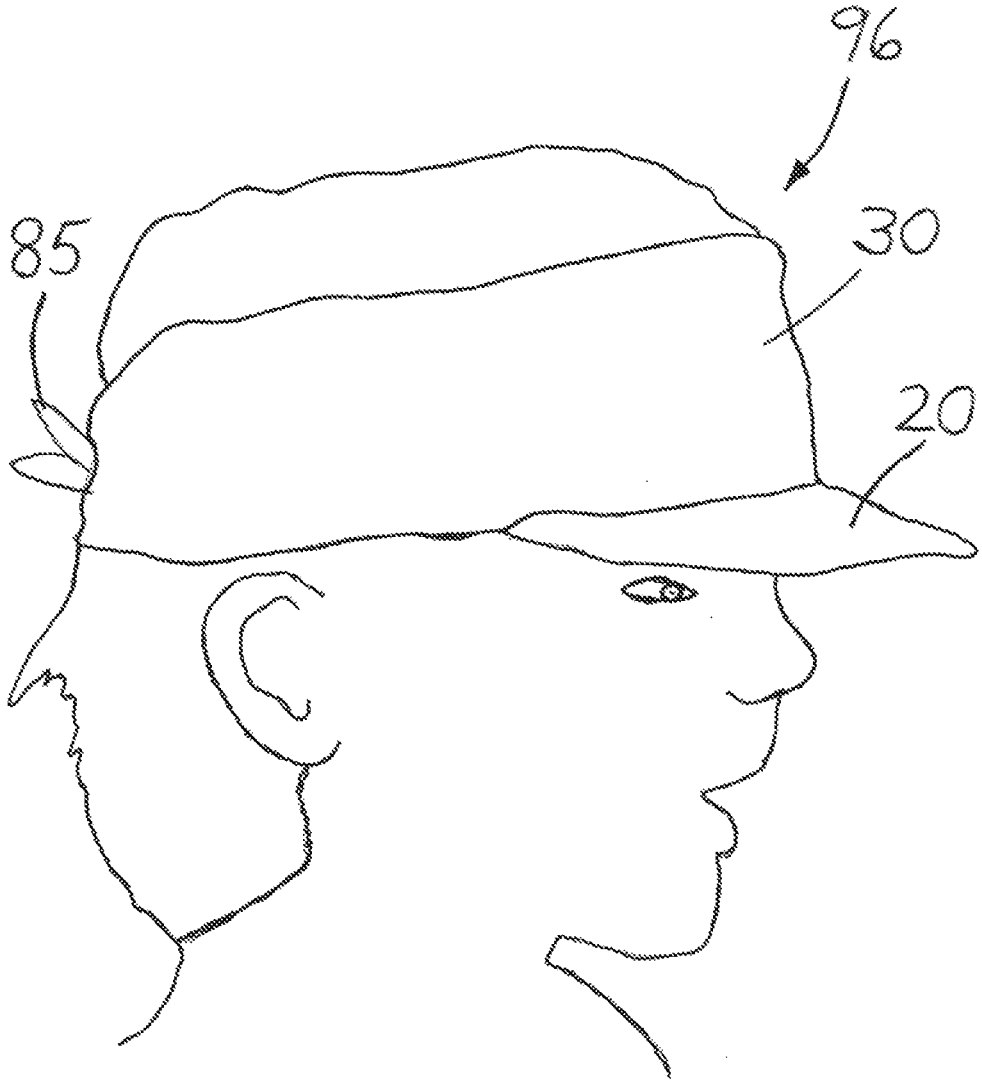
FIG. 6 illustrates step (290) of the flowchart shown in FIG. 4, showing an illustration of the present invention in its first style (96).
Figure 7:
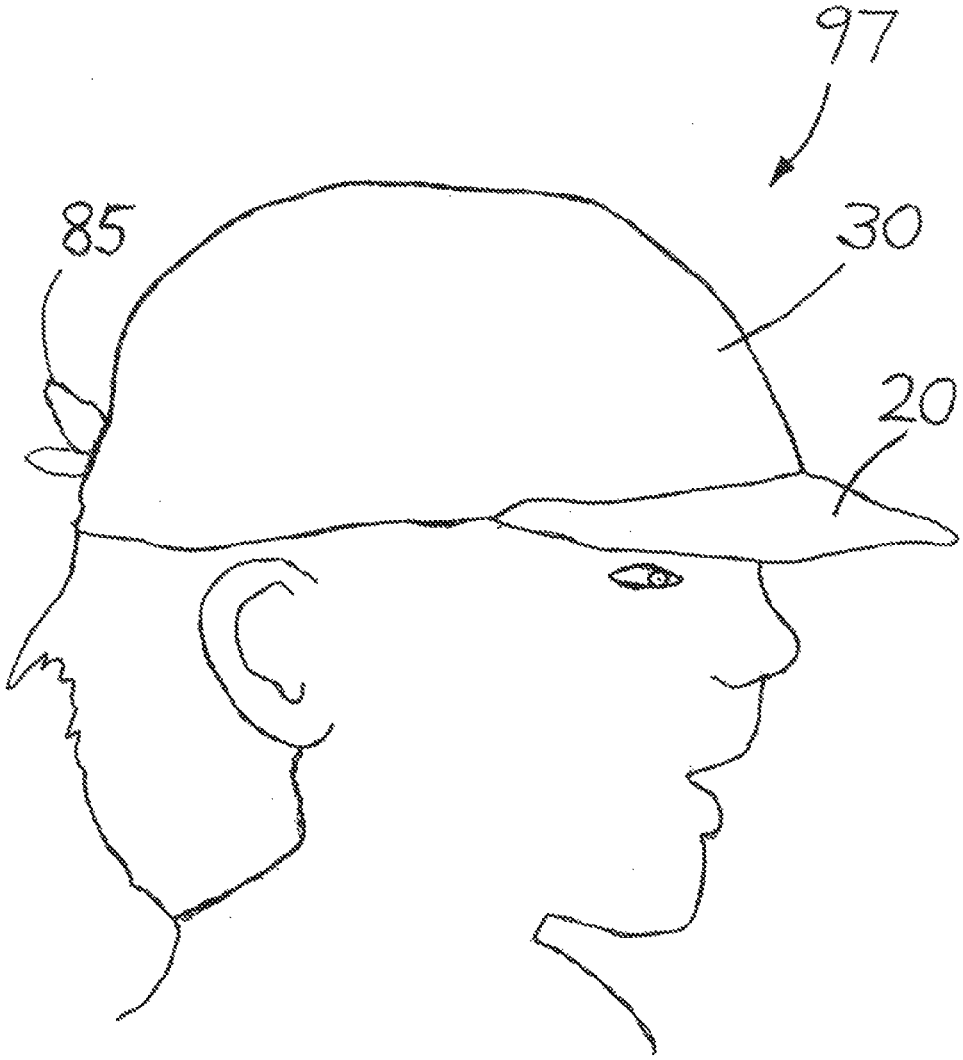
FIG. 7 illustrates step (310) of the flowchart shown in FIG. 4, showing an illustration of the present invention in its second style (97).
Figure 8:
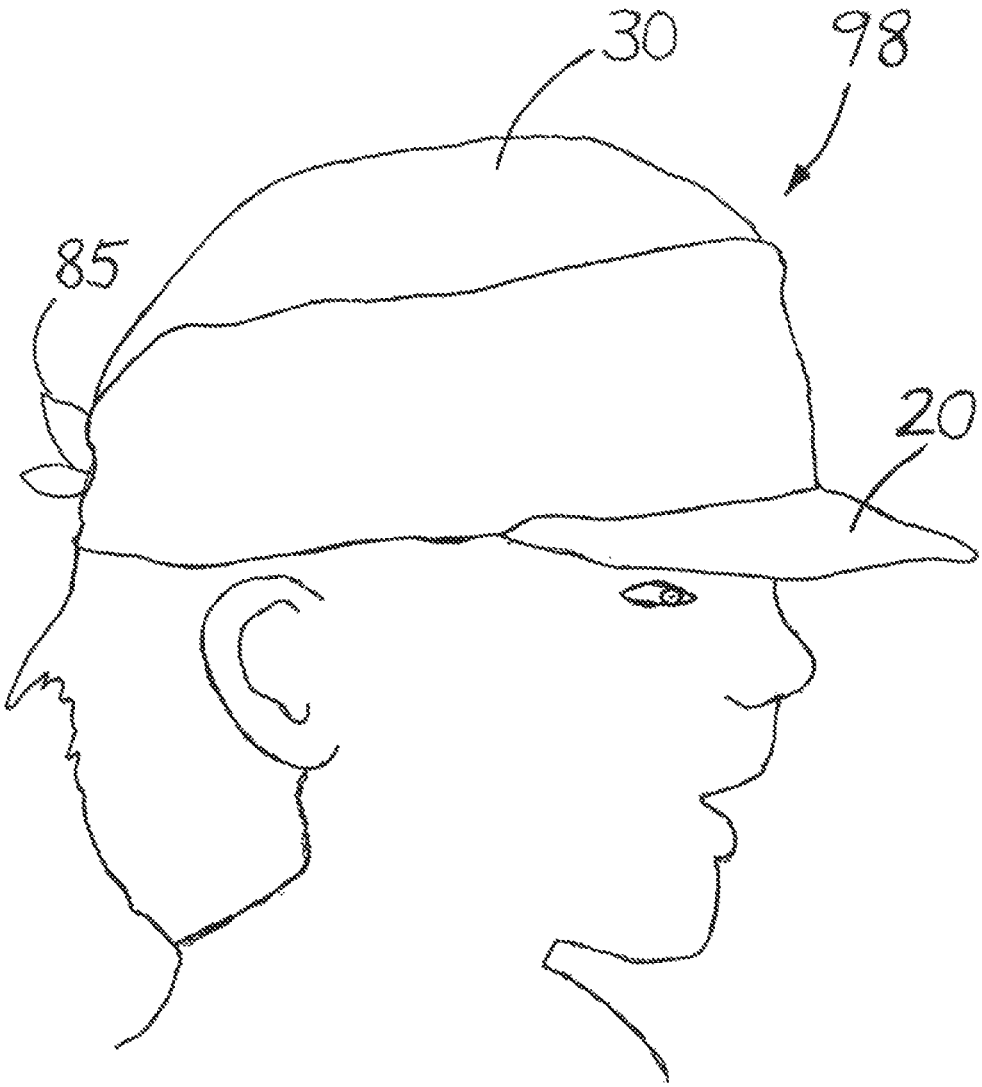
FIG. 8 illustrates step (330) of the flowchart shown in FIG. 4, showing an illustration of the present invention in its third style (98).

FIG. 4 is a continuation of the flowchart shown in FIG. 1, showing the concluding steps of constructing the present invention. The cloth is turned on a 45 degree angle to form a diamond shape (200) and a first imaginary line is drawn along the diagonal of the cloth from its rightmost point to its leftmost point (210). One inch below this first imaginary line, a second imaginary line is drawn parallel to it from edge to edge of the cloth (220). On this second imaginary line, a slit is cut that is the length of the visor bill cover (230). The top lip of material on the visor bill cover is stitched to the top portion of the slit (240), and the bottom lip of material on the visor bill cover is stitched to the bottom portion of the slit (250), so that the visor bill cover is attached to the cloth offset from the center of the cloth. The present invention can now be formed into three styles, a first style, a second style and a third style. Preliminary to forming these styles, the cloth is folded so that it is divided into uppermost and lowermost triangles that are laid on top of each other, with the visor bill cover attached to the lower edge of each of the triangles. (One of the triangles will be larger than the other because the visor bill cover is attached to the cloth one inch off center.) (270) Descriptions of the forming of the three styles are as follows. The first style is created by folding both the uppermost and lowermost triangles in one inch to 1½ inch wide folds from the tops of the triangles down to the lower edges where the visor bill cover is attached (280). The folded material is then wrapped around the user's head and tied in the back like a bandana (290). (This style is illustrated in FIG. 6.) The second style is created by folding only the lowermost triangle in one inch to 1½ inch wide folds from the top point of the lowermost triangle down to the lower edge where the visor bill cover is attached (300). The folded material is then wrapped around the user's head, with the uppermost triangle pushed over the user's head, and tied in the back like a bandana (310). (This style is illustrated in FIG. 7.) The third style is created by folding only the uppermost triangle in one inch to 1½ inch wide folds from the top point of the uppermost triangle down to the lower edge where the visor bill cover is attached (320). The folded material is then wrapped around the user's head, with the lowermost triangle pushed up underneath the folded material and over the user's head, and tied in the back like a bandana (330). (This style is illustrated in FIG. 8.)

Figure 5:
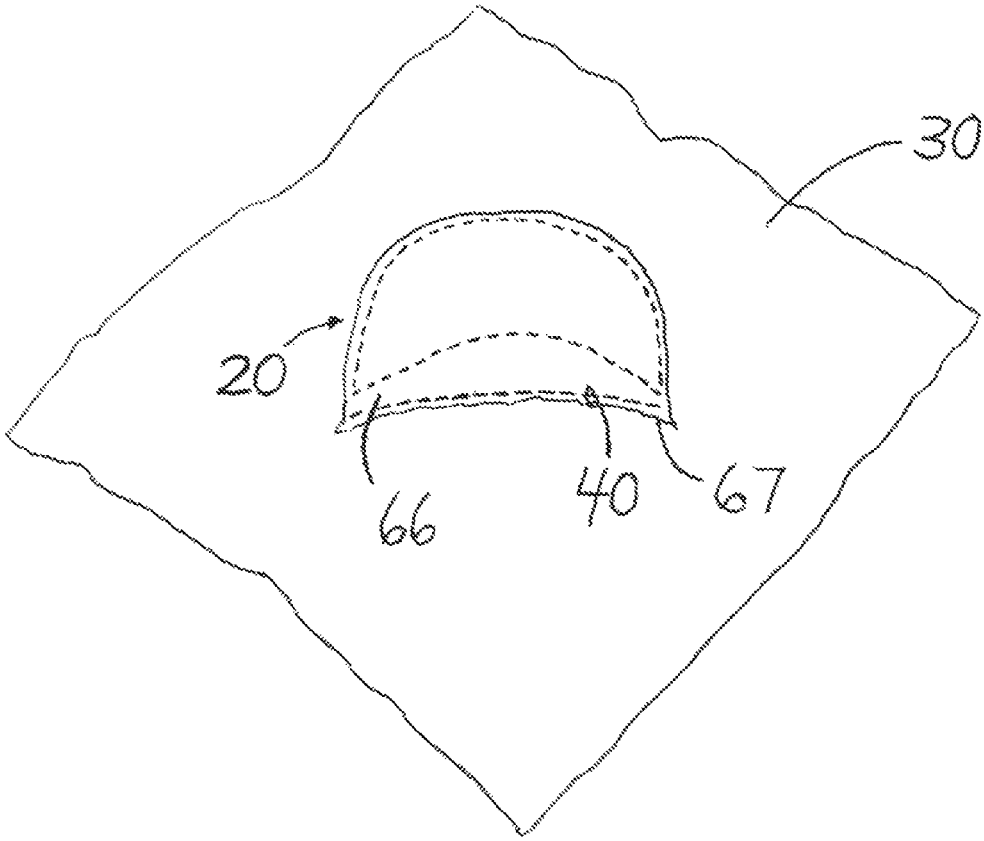
FIG. 5 illustrates step (250) of the flowchart shown in FIG. 4.

FIG. 5 illustrates step (250) of the flowchart shown in FIG. 4. The visor bill cover (20) is shown attached to the cloth (30) by means of stitching (40) that attaches the bottom lip (66) of cloth material on the visor bill cover (20) to the cloth (30) at the bottom portion of the slit (67).

FIG. 6 illustrates step (290) of the flowchart shown in FIG. 4, showing an illustration of the present invention formed in its first style (96). In the first style (96), the uppermost and lowermost triangles of the cloth (30) are folded and wrapped around the user's head, and secured into a tie (85) at the back of the user's head, leaving the top portion of the user's head exposed. Also shown in FIG. 6 is the visor bill cover (20) attached to the cloth (30).

FIG. 7 illustrates step (310) of the flowchart shown in FIG. 4, showing an illustration of the present invention in its second style (97). In the second style (97), the lowermost triangle of the cloth (30) is folded and wrapped around the user's head, and secured into a tie (85) at the back of the user's head. Also shown in FIG. 7 is the visor bill cover (20) attached to the cloth (30).

FIG. 8 illustrates step (330) of the flowchart shown in FIG. 4, showing an illustration of the present invention in its third style (98). In the third style (98), the uppermost triangle of the cloth (30) is folded and wrapped around the user's head, and secured into a tie (55) at the back of the user's head. Also shown in FIG. 8 is the visor bill cover (20) attached to the cloth (30).

Dimensions of the pieces that make up the present invention may vary. The sizes of the pieces may be larger or smaller than those described above in the preferred embodiment of the present invention. In addition, although the preferred embodiment envisions the components of the present invention attached to each other by conventional stitching, other means of attachment may also be employed.

It should be understood that the present invention is a visored cloth headgear, comprising a visor bill cover (20); a visor bill (10), disposed inside the visor bill cover (20); a cloth (30), attached to the visor bill cover (20); a tie (85), formed from the cloth (30); wherein the visor bill cover (20) is attached to the cloth (30) offset from the middle of the cloth (30); further comprising a top lip (63) and a bottom lip (66) of cloth material on the visor bill cover (20); wherein the top lip (63) and the bottom lip (66) are the points of attachment between the visor bill cover (20) and the cloth (30); further comprising a slit (67) in the cloth (30); wherein the slit (67) is the point of attachment between the visor bill cover (20) and the cloth (30); and wherein the slit (67) is the point of attachment between the top lip (63) and the bottom lip (66) of cloth material and the cloth (30); wherein the cloth (30) is folded, and wherein the cloth (30) has multiple folds.

I claim:

1. A visored cloth headgear, comprising:

a visor bill cover;

a visor bill, said visor bill permanently disposed inside said visor bill cover;

a cloth, said cloth attached to said visor bill cover;

a tie, said tie formed from said cloth;

wherein said tie is disposed at a rear of the visored cloth headgear;

wherein said visor bill cover is attached to said cloth offset from the middle of said cloth;

wherein said visor bill and said visor bill cover are fixed in position; and wherein said cloth is only bound to said visor bill cover, providing for modes of wear chosen from the group consisting of: a first mode wherein said cloth is partially unfurled into a head covering, a second mode wherein said cloth is folded into a band.

2. The visored cloth headgear of claim 1, further comprising a top lip and a bottom lip of cloth material on said visor bill cover.

3. The visored cloth headgear of claim 2, wherein said top lip and said bottom lip are the points of attachment between said visor bill cover and said cloth.

4. The visored cloth headgear of claim 1, further comprising a slit in said cloth.

5. The visored cloth headgear of claim 4, wherein said slit is the point of attachment between said visor bill cover and said cloth.

6. The visored cloth headgear of claim 4, further comprising a top lip and a bottom lip of cloth material on said visor bill cover, and wherein said slit is the point of attachment between said top lip and said bottom lip of cloth material and said cloth.

7. The visored cloth headgear of claim 1, wherein said cloth is folded.

8. The visored cloth headgear of claim 1, wherein said cloth has multiple folds.

9. A visored cloth headgear, comprising:

a visor bill cover;

a visor bill, said visor bill permanently disposed inside said visor bill cover;

a cloth, said cloth attached to said visor bill cover;

a tie, said tie formed from said cloth;

wherein said visor bill cover is attached to said cloth offset from the middle of said cloth;

a top lip and a bottom lip of cloth material on said visor bill cover;

wherein said top lip and said bottom lip are the points of attachment between said visor bill cover and said cloth;

further comprising a slit in said cloth;

wherein said slit is the point of attachment between said visor bill cover and said cloth;

wherein said cloth has multiple folds;

wherein said visor bill and said visor bill cover are fixed in position; and wherein said cloth is only bound to said visor bill cover, providing for modes of wear chosen from the group consisting of: a first mode wherein said cloth is partially unfurled into a head covering, a second mode wherein said cloth is folded into a band.

* * * * *